US005638983A

United States Patent [19]

Bazany

[11] Patent Number: 5,638,983

[45] Date of Patent: Jun. 17, 1997

[54] FLUTE ROD REINFORCED SLEEVE PACK

[75] Inventor: Donald J. Bazany, Grand Haven, Mich.

[73] Assignee: Bradford Company, Holland, Mich.

[21] Appl. No.: 574,122

[22] Filed: Dec. 18, 1995

Related U.S. Application Data

[63] Continuation-in-part of Ser. No. 501,613, Jul. 12, 1995.

[51] Int. Cl.[6] ..... B65D 1/48; B65D 6/34

[52] U.S. Cl. ..... 220/642; 220/650; 220/671

[58] Field of Search ..... 220/642, 645, 220/651, 650, 670, 1.5, 671, 669; 229/189.1, 199

[56] References Cited

U.S. PATENT DOCUMENTS

| | | | |
|---|---|---|---|
| 869,833 | 10/1907 | Ferres | 229/198.1 X |
| 2,200,867 | 5/1940 | Weltmer | 229/199 X |
| 3,370,734 | 2/1968 | Wilkins et al. | 220/642 X |
| 4,795,049 | 1/1989 | Alcorn | 220/642 |
| 5,042,713 | 8/1991 | Stafford | 220/441 X |

FOREIGN PATENT DOCUMENTS

| | | | |
|---|---|---|---|
| 0006993 | 3/1975 | Japan | 229/198.1 |

*Primary Examiner*—Allan N. Shoap
*Assistant Examiner*—Niki M. Kopsidas
*Attorney, Agent, or Firm*—Wood, Herron & Evans, L.L.P.

[57] ABSTRACT

A sleeve pack to be used with a pallet base and cover to form a container for shipping bulk goods, the sleeve pack comprising four continuous vertical sidewalls arranged in a rectangular configuration, at least one of the sidewalls having at least one vertically oriented flute rod inserted between two faces of corrugated plastic and within one flute of at least one wall for improved strength. The flute rod has an upholding means on the top of the flute rod for preventing the flute rod from falling through the flute of the sleeve pack sidewall. A channel shaped retainer covers and is secured to the upper portion of the sidewalls containing flute rods in order to secure the flute rods between the two faces of plastic of the sidewall and prevent the flute rods from falling out of the flutes when the sleeve pack is inverted. The upholding means of the flute rods are supported by vertically oriented corrugations between the face plies of the sidewalls.

28 Claims, 2 Drawing Sheets

FLUTE ROD REINFORCED SLEEVE PACK

CROSS-REFERENCE TO RELATED APPLICATIONS

This application is a continuation-in-part of application Ser. No. 08/501,613, filed Jul. 12, 1995, entitled Damage Resistant Container and Sleeve Pack Assembly and assigned to the assignee of this application.

FIELD OF THE INVENTION

The present invention relates to sleeve packs to be used with a pallet base and cover to form a container for shipping bulk goods and more particularly to a sleeve pack having reinforced sidewalls containing flute rods.

BACKGROUND OF THE INVENTION

Relatively large reusable containers are utilized by manufacturers to ship a variety of different products to their customers. For example, in the automobile industry, a plant assembling a particular automobile might utilize a number of different parts manufacturers. These manufacturers ship their respective parts to the plant in reusable containers where the parts are then assembled together into a finished automobile. The reusable containers are often returned to the parts manufacturers for use in further shipments, thus saving the manufacturers cost of the containers.

The construction of some such shipping containers includes a pallet base, a cover and a rectangular sleeve pack which is situated between the base and the cover to form the sidewalls and body of the container. Such a design provides a versatile and lightweight shipping container which may be reused time and time again. Such a container is commonly referred to as a sleeve pack assembly with the sleeve pack sandwiched between the cover and the pallet base. The vast majority of sleeve packs used today are made of heavy grades of triple ply corrugated paper or corrugated plastic.

As outdoor storage containers, plastic sleeve packs have been manufactured and utilized as weatherproof containers. However, both the plastic and paperboard existing sleeve packs have undesirable limitations. One of the potential problems with existing sleeve packs is the lack of ability of the sleeve pack walls to carry heavy vertical loads such as occurs when loaded sleeve packs are stacked one upon the other.

One of the methods utilized to increase the vertical strength or resistance to vertical collapse of the sleeve pack sidewalls has been to reinforce the sleeve pack sidewalls with steel rods commonly referred to in the industry as flute rods. Flute rods are inserted between adjacent vertically-oriented corrugations in the sidewalls of sleeve packs when the sleeve pack sidewalls are made of double face corrugated paper or plastic. Each sidewall has a plurality of vertically oriented corrugations, two adjacent corrugations defining a flute. The flute rods are inserted into the flutes of the sidewalls and provide the sidewalls of the sleeve pack additional strength to withstand both horizontal and vertical impacts.

The flute rods used to reinforce the sidewalls of a sleeve pack have heretofore been straight steel rods. One of the potential problems with inserting straight flute rods into the flutes of the sidewalls of the sleeve pack is that the flute rods would pass downwardly through the flutes of the sidewall when the sleeve pack was lifted away from the pallet base. If the sleeve pack were inverted the flute rods would fall out the top end rather than the bottom end of the sleeve pack sidewall. This made assembly and reuse of sleeve packs having flute rod reinforced sidewalls difficult, costly and frustrating.

To prevent the flute rods from falling from the flutes of the sleeve pack, the rods have in the past have been permanently secured therein. One technique used to secure the flute rods within the flutes of the sidewalls of a sleeve pack has been to inject a hot melt adhesive into the flutes located between the two faces of a sidewall of a sleeve pack so that the adhesive ran down the flutes between the two faces of the sidewalls between adjacent corrugations. Immediately after the hot melt adhesive has been inserted into the flutes, the flute rods are pressed down into the flutes filled with adhesive from the top edge of the sidewall.

One problem with this method of adhesively securing the flute rods inside the sleeve pack sidewalls has been that often the hot melt adhesive set up or hardened before all of the flute rods could be installed. Having the partially hardened adhesive located in the flutes of the sidewalls between the corrugations required that someone pound the flute rods down into the flutes of the sidewalls of the sleeve pack usually with a hammer or mallet.

Another potential problem with using adhesive to secure the flute rods inside the flutes of the sidewalls is that the hot adhesive may splatter and burn the operator. The adhesive may also splash onto the exterior of the sleeve pack and once hardened be difficult to remove. This method of securing the flute rods within the flutes filled with adhesive has therefore been relatively dangerous, messy, cumbersome and costly.

It has therefore been an objective of the present invention to provide a sleeve pack with flute rod reinforced sidewalls in which the flute rods are secured in the sidewalls of the sleeve pack in a safe, reliable and efficient manner.

It has been another objective of the present invention to provide a sleeve pack with flute rod reinforced sidewalls wherein the flute rods may not fall out of the sidewalls, enabling the sleeve packs to be conventionally reused.

It has been another objective of the present invention to provide a method of reinforcing sleeve pack sidewalls with vertically oriented flute rods which are secured in the sleeve pack sidewalls without the use of any adhesive within the flutes or internal fasteners.

SUMMARY OF THE INVENTION

The invention of the application which accomplishes these objectives comprises an improved corrugated plastic sleeve pack to be used with a pallet base and cover to form a container for shipping bulk goods in which at least one of four vertically oriented sidewalls of a sleeve pack has at least one vertically oriented flute rod inserted therein. Each sidewall of the sleeve pack has a top edge and a bottom edge defining the height of the sidewall and is made of double face corrugated plastic having multiple vertically oriented corrugations sandwiched between the two face plies, two adjacent corrugations together with the face plies defining a vertically oriented hollow flute. Each flute rod is inserted between the two faces of corrugated plastic within one flute of the sidewall for improved strength of the sidewall. A channel shaped retainer is inserted and secured over the top edge of the sidewall in order to hold the flute rods in place and prevent them from falling out of the sidewalls if the sleeve pack is inverted. The channel shaped retainer is secured to the sidewall by a securement which may be either adhesive or a rivet or a snap on clip.

The flute rods are typically made of steel but may be made of any other suitable material such as plastic or wood. Each flute rod has an upholding means on one end to prevent the flute rod from falling through the vertically oriented flutes. The upholding means may be a bend in the flute rod, a support bar or a planar head on one end of the flute rod. The upholding means sits on top of one or more of the vertically oriented corrugations of the sidewall. One form of flute rod used is in the shape of a "J" with a short leg connected to a long leg by a 180° bend. The long leg extends throughout the height of the sleeve pack sidewall inside one flute of the sidewall. The bend of such a flute rod rests on one or more vertically oriented corrugations between the long and short legs of the flute rod to prevent the flute rod from falling downward through the sleeve pack sidewall.

In order to prevent the flute rods from falling out the top edge of the sleeve pack sidewall when the sleeve pack is inverted, a channel shaped retainer is inserted over the top edge of a sidewall having flute rods inserted therein. The U-shaped retainer is then secured to the upper portion of the sidewall by a securement such as rivets or adhesive. Once secured, the channel shaped retainer prevents the flute rods from falling out the top edge of the sidewall when the sleeve pack is inverted.

The present invention may utilize one flute rod or a plurality of flute rods (up to one flute rod per flute of the sidewall) for extra strength. The number of flute rods is a function of the strength desired of the sidewalls.

One of the advantages of the present invention is that the flute rods sit loosely inside the flutes of the sidewalls of the sleeve pack without requiring any adhesive or other bonding material to secure them inside the sidewalls. The flute rods are free to move between the plastic faces of the sidewalls and between adjacent corrugations inside the sidewalls. The allowance of such movement prevents the cracking or breaking of the faces of the sleeve pack sidewalls when the sleeve pack is exposed to severe weather.

These and other objects and advantages of the invention will be more apparent from the following description of the drawings in which:

DETAILED DESCRIPTION OF THE PREFERRED EMBODIMENT

Figure 1:
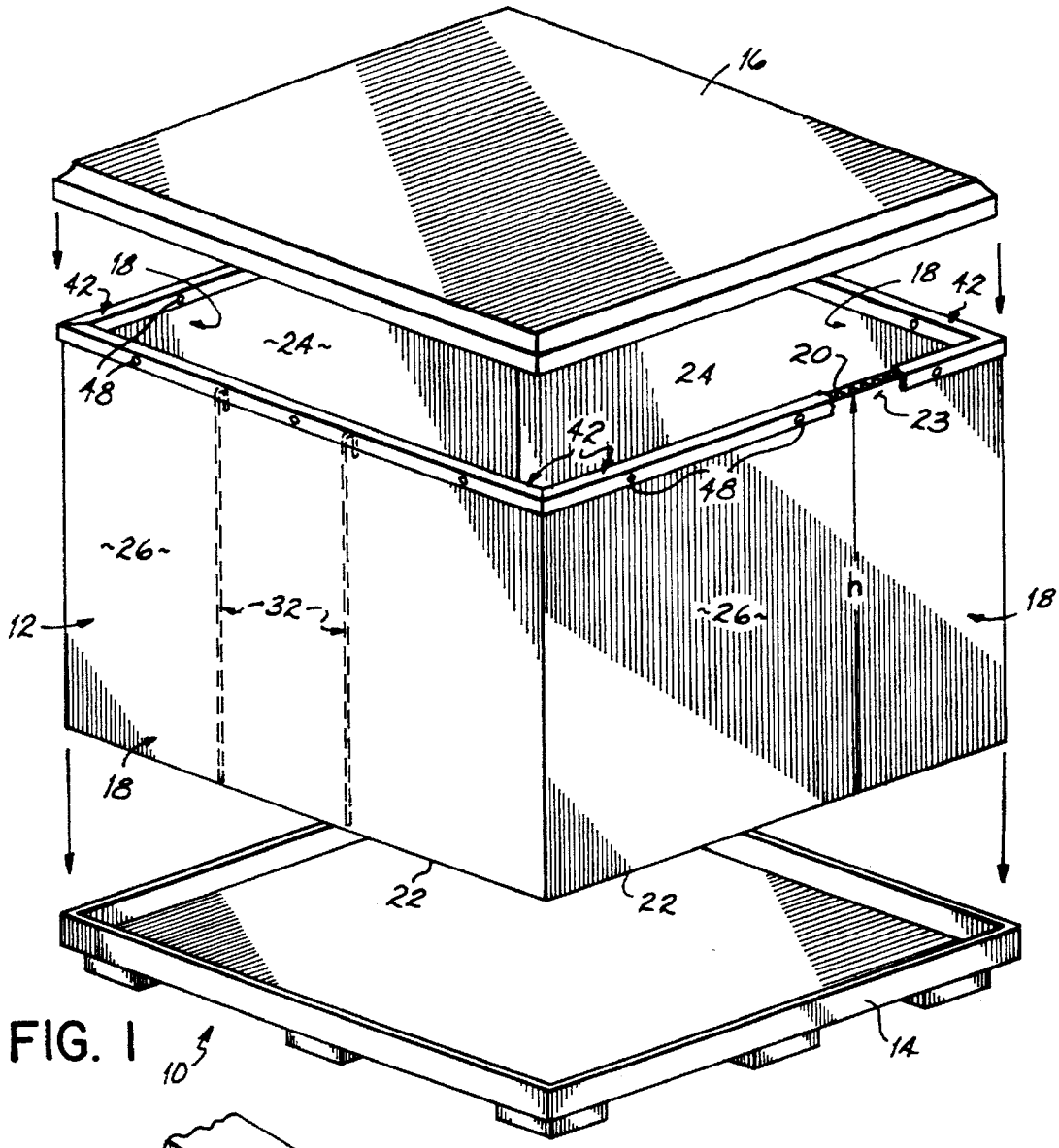
FIG. 1 is an exploded perspective view of a sleeve pack assembly of the present invention, the sleeve pack having two flute rods inserted into one of the sidewalls of the sleeve pack.

Referring to the drawings, and particularly to FIG. 1, there is illustrated a sleeve pack assembly 10 comprising a sleeve pack 12, a pallet base 14, and a cover 16. The sleeve pack 12 sits on top of the pallet base 14 and a cover 16 is placed on the sleeve pack to form a container for shipping bulk goods such as automobile parts or different assembly items.

Figure 2:
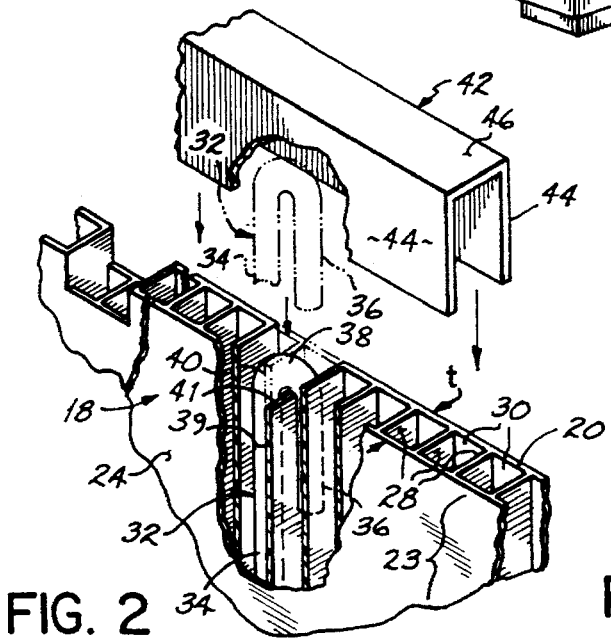
FIG. 2 is an exploded perspective view of a portion of one of the sidewalls of the sleeve pack, the sidewall having a shepherd's crook shaped flute rod inserted therein and a channel shaped retainer placed over the top edge of the sleeve pack wall.
Figure 3:
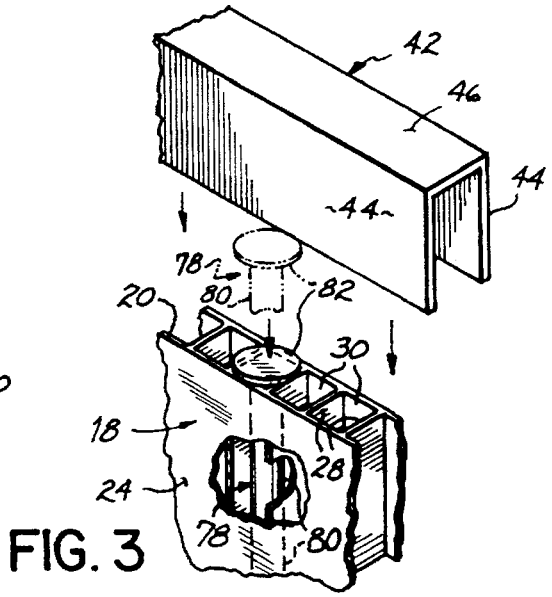
FIG. 3 is an exploded perspective view of a portion of a sidewall of the sleeve pack of the present invention having a nail shaped flute rod inserted therein and retained with a channel shaped retainer placed on top of the sidewall.

The sleeve pack 12 has four continuous sidewalls 18, each sidewall being attached in any conventional manner to an adjacent sidewall 18. The sleeve pack sidewalls 18 may be oriented in a rectangular configuration such that each sidewall 18 is orthogonal to an adjacent sidewall 18 and parallel to an opposing sidewall 18 to form a rectangular sleeve pack 12. Each sidewall 18 has a planar top edge 20 and a planar bottom edge 22 defining the height "h" of the sidewall and an upper wall portion 23. As shown in FIGS. 2 and 3 each sidewall is made up of an inner face of plastic 24 and an outer face of plastic 26 parallel to the inner face 24. The inner and outer faces of the sidewall 18 define the thickness "t" of the sidewall. Between the faces of plastic of the sidewall are a plurality of vertically oriented corrugations or partitions 28 which define a plurality of vertically oriented flutes or channels 30 therebetween. The distance between two adjacent vertically oriented corrugations or partitions and the distance between the inner and outer faces of the sidewall 18 define the size of flutes or channels 30. The flutes and the corrugations are vertically oriented within the inner and outer faces of the corrugated plastic sidewall 18.

As best illustrated in FIG. 1 at least one sidewall 18 of the sleeve pack has embedded therein a plurality of flute rods 32 which extend from proximate the top edge 20 of the sleeve pack sidewall 18 to proximate the bottom edge 22 of the sleeve pack sidewall 18. Each flute rod 32 is inserted between the two faces 24, 26 of the sidewall 18 such that it fits down into a flute 30 of the sidewall 18 and is prevented from moving laterally by the two faces of plastic and the two corrugations 28 adjacent the flute 30.

In the preferred embodiment of the invention each of the flute rods 32 is generally in the shape of a "J" or shepherd's crook. As best illustrated in FIG. 2, each "J" shaped flute rod 32 has a long leg 34 and a short leg 36 connected by a 180° bend 38. The bend 38 rests on a corrugation 28 preventing the flute rod 32 from passing downward through the sidewall 18. The short leg 36 of each flute rod 32 rests in a flute 30 between two adjacent corrugations 28 while the long leg 34 of the same flute rod 32 rests between two adjacent corrugations 28 in an adjacent flute 30, the bend 38 of the flute rod 32 lying over a common corrugation 39. A portion 40 of the common corrugation 39 and a portion of the inner and outer face plies 24, 26 of the sidewall 18 may be cut out so that the bend 38 of the flute rod 32 does not extend above the plane of the top edge 20 of the sidewall 18. Alternatively, the flute rods 32 may be pounded downward into the sidewalls 18 with a hammer or mallet so that the bends 38 of the flute rods 32 do not extend above the plane of the top edge 20 of the sidewall 18. The short leg 36 of the flute rod 32, as seen in FIG. 2, extends partially down the height of the sidewall 18 whereas the long leg 34 of the flute rod 32 extends throughout the entire height "h" of the sidewall 18.

Alternatively, the short leg 36 of the "J" shaped flute rod 32 may rest in a flute 30 two or more flutes away from the flute which houses the long leg 34 of the "J" shaped flute rod 32. In this embodiment, at least one empty flute 30 would exist between the flute in which the long leg 34 of the flute rod 32 rests and the flute in which the short leg 36 of the flute rod 32 rests. The 180° bend 38 of the flute rod 32 would rest on at least two vertically oriented corrugations 28 preventing the flute rod 32 from passing downward through the sidewall 18.

As illustrated in FIGS. 2 and 3, the flute rods are positioned above the sleeve pack sidewalls 18 and lowered one at a time or several simultaneously downwardly into the flutes 30 of the sidewalls 18. In the case of the "J" shaped flute rods 32 illustrated in FIG. 2, the long leg 34 of each "J" shaped flute rod 32 is lowered into a first flute 30 of the sidewall 18. The flute rod 32 is then rotated as necessary so that the short leg 36 of the flute rod 32 is positioned directly above a second flute. The second flute may be immediately adjacent the first flute, the first and second adjacent flutes being separated by a common corrugation 39. Alternatively, the second flute may be separated from the first flute by one or more empty flutes, the flute rod 32 being supported by more than one vertically oriented corrugation 28. The "J" shaped flute rod is then further lowered with the short leg 36 of the flute rod 32 passing into the second flute until the bend 38 of the flute rod 32 rests on the top edge 41 of one or more vertically oriented corrugations 28. The entire flute rod 32 is then between the inner and outer faces 24, 26 of the sidewall 18 and underneath the horizontal plane of the top edge 20 of the sidewall 18. The flute rod 32 is prevented from falling out the bottom edge 22 of the sidewall 18 by the bend 38 of the flute rod 32 catching one or more vertically oriented corrugations 28.

Once all the flute rods 32 of the sleeve pack 12 are inserted into the sidewalls 18 of the sleeve pack 12, a channel shaped retainer 42 is positioned above a sidewall 18 having flute rods inserted therein and moved downwardly so the two legs 44 of the channel shaped retainer 42 are outside of the inner and outer faces of plastic of the corrugated sidewall 18. Each channel shaped retainer has a planar top 46 which connects and is perpendicular to the two legs 44 of the channel shaped retainer 42. The top 46 of the channel shaped retainer 42 is lowered until it rests on the horizontal planar top edge 20 of the sidewall 18.

Figure 4:
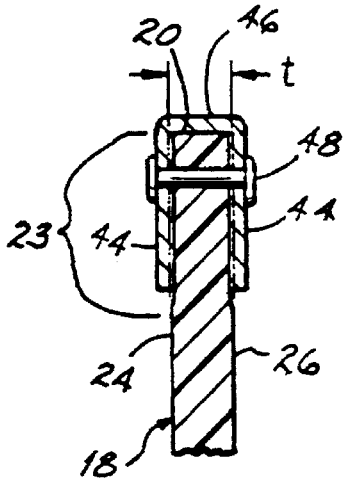
FIG. 4 is a cross-sectional view of a sidewall of the sleeve pack of the present invention having a channel shaped retainer secured to the top of the sidewall by rivets.

Once the channel shaped retainer 42 is placed on and over the upper portion 23 of the sidewall 18 some sort of securement fixing the channel shaped retainer 42 to the upper portion 23 of the sidewall 18 is required so that when the sleeve pack 12 is inverted the channel shaped retainer 42 does not fall off the sidewall 18 and allow the flute rods 32 to fall out of the sidewalls 18. The securement may be an adhesive, a rivet, a clip or any other conventional fastener. FIG. 4 illustrates a U-shaped channel retainer 42 secured to the upper portion 23 of a sidewall 18 by at least one rivet 48. Each rivet 48 passes through both legs 44 of the channel shaped retainer 42 and through the thickness "t" of the upper portion 23 of sleeve pack sidewall 18. As illustrated in FIG. 1, any number of rivets 48 may be used to secure the channel shaped retainer 42 to the upper portion 23 of the sidewall.

Figure 5:
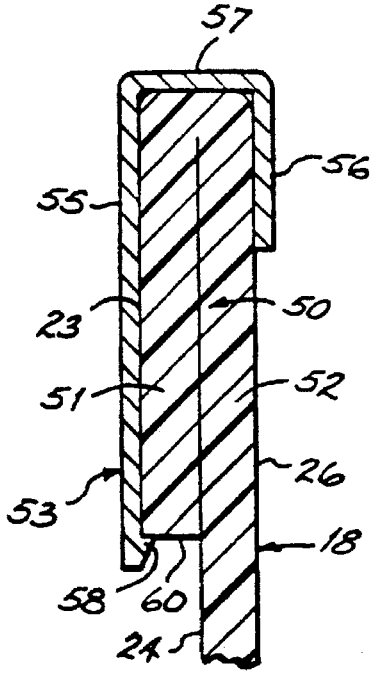
FIG. 5 is a cross-sectional view of a double wall portion of a sleeve pack sidewall with a channel shaped retainer clip secured to the sidewall.

Typically the sleeve pack sidewalls 18 are one thickness 10 millimeter thick corrugated plastic as described hereinabove. As seen in FIG. 5, an alternative embodiment of the sleeve pack 12 of the present invention includes sidewalls 18 which are folded over at their upper ends to provide a double thickness wall portion 50 along the upper portions 23 of the sleeve pack sidewalls 18. The double wall portion 50 of the sleeve pack sidewalls 18 enhances the strength of the sleeve pack and provides structural support for the container cover 16.

In order to form the double wall portion 50 of a sleeve pack sidewall 18 the upper portion 23 or top flap of the sidewall 18 is folded inwardly forming an inner thickness 51 and an outer thickness 52. The outer thickness 52 extends the entire height of the sleeve pack sidewall 18 whereas the inner thickness 51 extends downwardly only an inch or two over the outer thickness 52 of the sidewall 18. The flute rods (not shown) extend downward inside the outer thickness 52 of the sidewalls.

A clip-on retainer 53, as illustrated in FIG. 5 is used to secure flute rods inside a sleeve pack having sidewalls with a double wall thickness portion 50. The clip-on retainer 53 has an inner retainer wall 55, an outer retainer wall 56 and a top retainer wall 57. The outer retainer wall 56 covers the upper portion 23 of the outer thickness 52 of the sidewall 18. The outer retainer wall 56 then is angled 90° and forms a top retainer wall 57 which covers the planar top edge 20 of the sidewall 18. The top retainer wall 57 is then angled 90° downward and forms an inner retainer wall 55 which is longer than the outer retainer wall 56 and terminates in an inwardly facing ridge or hook 58 which rests on the bottom edge 60 of the inner ply 51 of the double wall portion 50 of the sidewall 18. This type of clip on retainer 53 does not require any additional fastening or securing device and may simply be clipped on top of the double wall portion 50 of the sidewall 18.

Figure 6:
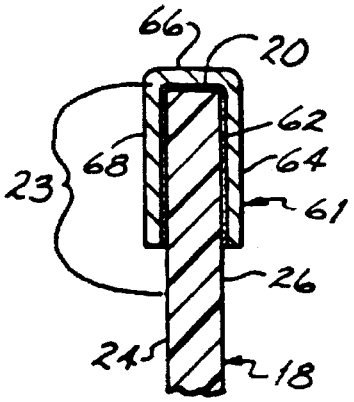
FIG. 6 is a cross-sectional view of a sidewall of the sleeve pack of the present invention with a channel shaped retainer secured to the top of the sidewall by adhesive.

Shown in FIG. 6 is a U-shaped channel retainer 61 secured to the upper portion 23 of a sidewall 18 with a layer of adhesive 62. The layer of adhesive 62 lays between the upper portion 23 of the sidewall 18 and the U-shaped channel retainer 61. The U-shaped channel retainer 61 has an outer retainer wall 64, a top retainer wall 66 and an inner retainer wall 68 which extends downward at 90° from the top retainer wall 66. This form of retainer may also be utilized with a folded over sleeve pack sidewall 18 as shown in FIG. 5 having inner and outer thicknesses of a double wall portion 50.

Figure 7:
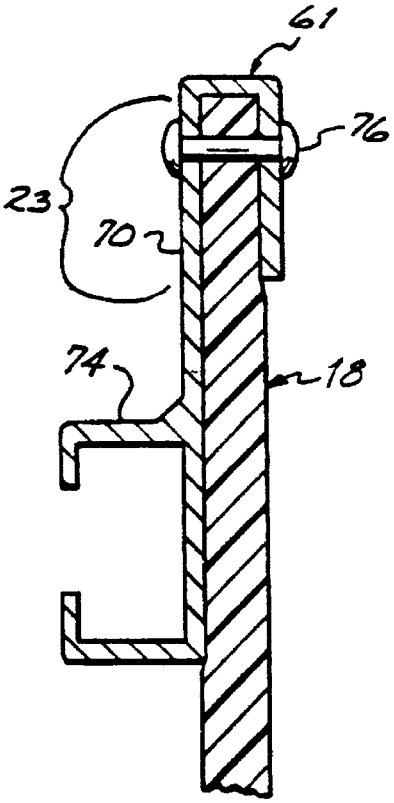
FIG. 7 is a cross-sectional view of a sidewall of the sleeve pack of the present invention having a channel shaped retainer with a C-shaped channel attached to the inner wall of the retainer, the retainer being secured to an upper portion of the sidewall by rivets.

As illustrated in FIG. 7, the inner wall 70 of a U-shaped channel retainer 72 may extend downwardly and have attached thereto a C-shaped channel 74 which receives and supports the end of telescoping support bars to be utilized inside the sleeve pack as described in assignee's own pending U.S. patent application Ser. No. 08/501,613. A U-shaped channel retainer 72 having a C-shaped channel 74 attached to the inner wall 70 of the U-shaped channel retainer 72 may be secured to the upper portion 23 of a sidewall 18 by a rivet 76 (as shown), adhesive or any other conventional fastener. A C-shaped channel for receiving and supporting the ends of telescoping support bars may also be placed on the inner wall of a clip-on retainer like the one illustrated in FIG. 5.

FIG. 3 illustrates an alternative embodiment of the present invention utilizing a flute rod 78 configured differently from the "J"-shaped flute rod 32 of FIGS. 1 and 2. The flute rod 78 of this alternative embodiment is actually in the form of a nail having a central long leg 80 which extends upwardly terminating in a flute rod head 82. The head 82 is large enough so that the head 82 will not pass through a flute 30 of a sidewall 18 but rather rests on the planar top edge of the vertically oriented corrugations 28 and inner and outer faces 24, 26 of the sidewalls 18, preventing the flute rod 78 from falling downwardly through the flute 30 of the sidewall 18. The head 82 must be small enough so that the U-shaped channel retainer 42 may fit over the sidewall 18 and the head 82 of the flute rod 78 inserted inside the sidewall 18. With the flute rod 78 illustrated in FIG. 3 as many flute rods 78 as there are flutes 30 in the sidewall 18 may be utilized depending upon the strength of the sidewalls desired. On the other hand, the sidewalls 18 containing "J" shaped flute rods 32 are limited in that only one flute rod 32 may be inserted per two or more flutes 30 because each "J" shaped flute rod requires two flutes, one for the long leg 34 and one for the short leg 36 of the flute rod 32.

Further embodiments of the present invention include flute rods configured in either a "T" or "L" shape. Although not specifically illustrated, these alternative flute rods, like the "J" shaped flute rod and the nail shaped flute rod, have a linear lower leg which extends upwardly terminating in an upholding means. The upholding means rests on the top edge of one or more vertically oriented corrugations. In the case of a "T" or "L" shaped flute rod the upholding means is a linear support bar which is orthogonal to the linear lower leg of the flute rod and prevents the flute rod from passing through the sidewall.

While we have described several embodiments of the present invention, persons skilled in the art will appreciate changes and modifications which may be made without departing from the invention of this application. Having described our invention we claim:

1. A sleeve pack to be used with a pallet base and cover to form a container for shipping bulk goods, the sleeve pack comprising:

four vertical wails configured in a rectangular configuration such that each wall orthogonal to an adjacent wall and parallel to an opposing wall, each wall having a top edge and a bottom edge defining a height, each wall being made of double face plastic having multiple partitions separated by channels sandwiched between two face plies, all of the partitions and channels being vertically oriented and said partitions having a top edge; said sleeve pack having four corners;

at least one vertically oriented flute rod inserted between the two faces of plastic and within one channel of at least one wall between and spaced from said corners of said sleeve pack in order to strengthen said at least one wall, each flute rod having only one leg extending throughout said height and upholding means for supporting said flute rod on the top edge of at least one partition preventing said flute rod from passing downwardly through said at least one wall of said sleeve pack; and a channel shaped retainer covering a top edge of said at least one wall to hold said at least one flute rod in place, said retainer being secured to said at least one wall by a securement.

2. The sleeve pack of claim 1 wherein said at least one vertically oriented flute rod is a steel rod.

3. The sleeve pack of claim 1 wherein each of said at least one vertically oriented flute rod is generally in the shape of a nail, said nail comprising a flat head of a first diameter and a rod body of a second smaller diameter extending downwardly from said head.

4. The sleeve pack of claim 3 wherein the upholding means of each flute rod is said flat head of said nail shaped flute rod.

5. The sleeve pack of claim 1 wherein each of said flute rods is generally in the shape of a "J" with a downwardly extending short leg and a downwardly extending long leg, said legs being connected by a bend.

6. The sleeve pack of claim 1 wherein each of said at least one flute rod extends from proximate a top edge of said at least one wall of the sleeve pack to proximate a bottom edge of said at least one wall of the sleeve pack.

7. The sleeve pack of claim 1 wherein said at least one flute rod extends approximately the height of said at least one wall.

8. The sleeve pack of claim 1 wherein the upholding means is a hook having a downwardly extending short leg inserted between the two faces of plastic and into a second channel.

9. The sleeve pack of claim 1 wherein said upholding means of each said flute rod rests between the two faces of plastic on a partition of a lesser height than adjacent partitions.

10. The sleeve pack of claim 9 wherein said flute rod does not extend above the top edge of at least one wall.

11. The sleeve pack of claim 1 wherein said securement is an adhesive.

12. The sleeve pack of claim 1 wherein said securement is at least one rivet.

13. A sleeve pack to be used with a pallet base and a cover to form a container for shipping bulk goods, the sleeve pack comprising:

four connected vertical wails oriented in a rectangular configuration, each wall being of double face plastic having vertically oriented partitions and channels defined between the two faces of plastic, each wall having a height defined between a top edge and a bottom edge and a length, said sleeve pack having four corners;

a plurality of "J" shaped flute rods, each flute rod having a short leg and a long leg connected by a bend, said short leg and said long leg extending downwardly from opposite ends of said bend, each of said flute rods being inserted into a wall between the two faces of plastic with the long leg of each flute rod located within one channel of a wall and the short leg of the rod located within a second channel of said wall, said long and short legs being separated by one partition which prevents said at least one flute rod from moving downwardly in said channels, said flute rods being located along the lengths of said walls spaced from said corners.

14. The sleeve pack of claim 13 wherein said plurality of flute rods are made of steel.

15. The sleeve pack of claim 13 wherein the long leg of each flute rod is inserted between a first and second adjacent partition of said wall and the short leg of the flute rod is inserted between said second partition and a third partition of said wall adjacent said second partition.

16. The sleeve pack of claim 15 wherein the long leg of each flute rod extends throughout approximately the height of one of the sleeve pack walls.

17. The sleeve pack of claim 13 wherein the bend of each flute rod rests in a cut-out area of one wall so that the bend does not protrude above a top edge of the sleeve pack wall.

18. A sleeve pack to be used with a pallet base and a cover to form a container for shipping bulk goods, the sleeve pack comprising:

four vertical sidewalls arranged in a rectangular configuration, each sidewall being attached to two adjacent sidewalls at a corner, each sidewall being made of double face plastic having vertically-oriented partitions and channels;

at least one flute rod having a support at one end, said support abutting a top edge of at least one of said vertically-oriented partitions, said at least one flute rod being inserted between two faces and between adjacent vertically-oriented partitions of at least one sidewall between and spaced from said corners, said at least one flute rod functioning to strengthen said at least one sidewall; and a retainer covering a top edge of said at least one sidewall to hold said at least one flute rod in place, said retainer being permanently attached to said at least one sidewall.

19. The sleeve pack of claim 18 wherein said at least one flute rod is made of steel.

20. The sleeve pack of claim 18 wherein said retainer is secured to said at least one sidewall by an adhesive.

21. The sleeve pack of claim 18 wherein said retainer is secured to said at least one sidewall by at least one rivet.

22. The sleeve pack of claim 18 wherein said retainer is a U-shaped channel.

23. The sleeve pack of claim 18 wherein each of the flute rods has a long leg and a short leg connected by a bend, said long and short legs extending downwardly within adjacent channels from a top portion of said at least one sidewall, said long and short legs being separated by one partition which prevents said at least one flute rod from moving downwardly in said channels.

24. A method of strengthening at least one wall of a corrugated plastic sleeve pack to be used with a pallet base and cover to form a container for shipping bulk goods comprising the steps of:

inserting at least one flute rod between two adjacent partitions and between two opposing faces of plastic of at least one wall of said sleeve pack between and spaced from the ends of said at least one wall, supporting each flute rod from a top edge of a partition, each flute rod having a length of approximately the height of one wall;

covering an upper portion of said at least one wall with a U-shaped retainer; and securing said U-shaped retainer to said upper portion of said at least one wall to prevent the at least one flute rod from falling out of said at least one wall.

25. The method of strengthening at least one wall of a sleeve pack as in claim 24 wherein said retainer is adhered to said upper portion of said at least one wall.

26. The method of strengthening at least one wall of a sleeve pack as in claim 24 wherein said retainer is riveted to said upper portion of said at least one wall.

27. The method of strengthening at least one wall of a sleeve pack as in claim 24 wherein at least one flute rod is inserted between the opposing faces of plastic in each of the walls of the sleeve pack.

28. A sleeve pack to be used with a pallet base and a cover to form a container for shipping bulk goods, the sleeve pack comprising:

four vertical sidewalls arranged in a rectangular configuration, each sidewall being attached to two adjacent sidewalls, each sidewall being made of double face plastic having vertically-oriented partitions and channels;

at least one flute rod having a long leg and a short leg connected by a bend, said long and short legs extending downwardly within adjacent channels from a top portion of said at least one sidewall, said long and short legs being separated by one partition which prevents said at least one flute rod from moving downwardly in said channels, said at least one flute rod being inserted between two faces and between adjacent vertically-oriented partitions of the same sidewall; and a retainer covering a top edge of said at least one sidewall to hold said at least one flute rod in place, said retainer being permanently attached to said at least one sidewall.

* * * * *